US009735513B2

(12) United States Patent
Nakai et al.

(10) Patent No.: US 9,735,513 B2
(45) Date of Patent: Aug. 15, 2017

(54) SHIELDED SHELL AND SHIELDED CONNECTOR

(71) Applicant: Sumitomo Wiring Systems, Ltd., Yokkaichi, Mie (JP)

(72) Inventors: Hirokazu Nakai, Mie (JP); Motohiro Ando, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/372,034

(22) Filed: Dec. 7, 2016

(65) Prior Publication Data

US 2017/0170609 A1 Jun. 15, 2017

(30) Foreign Application Priority Data

Dec. 10, 2015 (JP) ..... 2015-240731

(51) Int. Cl.
*H01R 13/60* (2006.01)
*H01R 13/6596* (2011.01)
*H01R 13/74* (2006.01)

(52) U.S. Cl.
CPC ..... *H01R 13/6596* (2013.01); *H01R 13/74* (2013.01)

(58) Field of Classification Search
CPC .. H01R 13/6596; H01R 13/74; H01R 13/516; H01R 13/5219; H01R 9/032
USPC ..... 439/538
See application file for complete search history.

(56) References Cited

U.S. PATENT DOCUMENTS 5,954,542 A * 9/1999 Wu ..... H01R 13/516 439/584
8,734,179 B2 * 5/2014 Tsai ..... H01R 13/516 29/857
8,905,770 B2 * 12/2014 Fujiwara ..... H01R 13/516 439/181
9,083,107 B2 * 7/2015 Suzuki ..... H01R 13/5219
2014/0235101 A1 * 8/2014 Derbogen ..... H01R 9/032 439/607.01
2015/0318679 A1 11/2015 Nakai

FOREIGN PATENT DOCUMENTS

JP 2014060844 A 4/2014

* cited by examiner

*Primary Examiner* — Jean F Duverne
(74) *Attorney, Agent, or Firm* — Reising Ethington P.C.

(57) ABSTRACT

A shielded shell and a shielded connector that prevents a fixing member for fixing a shielding member from interfering with another member such as a grommet. A shielding member such as a braided wire is placed on the outer circumferential surface of a shielded shell and fixed by the fixing member. The outer circumferential surface of the shielded shell is provided with a step portion that increases in diameter from the rear portion, at which a fixing region of the shielding member is positioned, toward a front portion, and is provided with position restriction portions that protrude outward from portions of the outer circumferential surface in the circumferential direction and restrict the position of the front end of the fixing member that is to be attached to the fixing region.

4 Claims, 8 Drawing Sheets

SHIELDED SHELL AND SHIELDED CONNECTOR

This application claims the benefit of Japanese Application No. JP2015-240731, filed on Dec. 10, 2015, the contents of which are hereby incorporated by reference in their entirety.

FIELD

The present invention relates to a shielded shell and a shielded connector.

BACKGROUND

JP 2014-60844A discloses a shielded shell that is used when connecting an inverter to a motor of a hybrid vehicle with electrical lines, and is fixed to a casing on the inverter side via a bolt. This shielded shell is made of metal and has a tubular shape, and a connector on the harness side is accommodated therein. A connection portion is provided on the rear end portion of the shielded shell, and a step portion that is one size larger than the connection portion is provided forward of the connection portion. A braided wire (shielding member) is placed over the outer circumferential surface of the rear end portion of the connection portion. The braided wire is fixed to the connection portion by a ring-shaped tightener (fixing member).

Also, the main body portion of a grommet is placed around the outer circumferential surface of the front end portion of the connection portion. The main body portion of the grommet is fixed to the connection portion by a tying band. Furthermore, a bulging portion that bulges outward is formed on the grommet, and a space for accommodating the tightener is ensured inside in the bulging portion.

In the conventional shielded shell described above, the outer circumferential surface of the connection portion is continuous with no protrusions/recessions in the front-rear direction, and therefore there is a possibility that the tightener will become shifted in the front-rear direction. If the tightener becomes shifted forward, there is a risk that the tightener will interfere with the grommet and negatively influence the sealing performance of the grommet.

The present design was achieved in light of the above-described circumstances, and an object thereof is to provide a shielded shell and a shielded connector that can prevent a fixing member for fixing a shielding member from interfering with another member.

SUMMARY

A shielded shell according to one aspect is a shielded shell having an outer circumferential surface on which a shielding member is to be placed and fixed by a fixing member, the outer circumferential surface being provided with a step portion that increases in diameter from a rear portion at which a fixing region of the shielding member is positioned toward a front portion, and a position restriction portion that protrudes outward from a portion of the outer circumferential surface in a circumferential direction and restricts a position of a front end of the fixing member that is to be attached to the fixing region.

The position of the front end of the fixing member is restricted by the position restriction portion, thus making it possible to prevent the fixing member from becoming shifted forward relative to the shielded shell and interfering with another member at a forward position. In this case, the position restriction portion is provided on only a certain portion in the circumferential direction on the outer circumferential surface of the shielded shell, thus making it possible to more easily avoid interference between another member and the position restriction portion. On the other hand, if the position restriction portion is provided on only a certain portion in the circumferential direction on the outer circumferential surface of the shielded shell, there is concern that the fixing member will become tilted in a direction that intersects the front-rear direction, but in the present invention, the front end of the fixing member abuts against the step portion, thus making it possible to prevent tilting of the fixing member.

DRAWINGS

DESCRIPTION

Examples of preferred embodiments are described below.

The outer circumferential surface may have an approximately flat straight portion, and the position restriction portion may be provided on the straight portion. According to this configuration, the position restriction portion can be formed easily, and the position restriction portion can be visually recognized easily.

A grommet that surrounds the shielding member and the fixing member may be placed over the front portion, and the position restriction portion may be provided so as to extend into the rear portion. According to this configuration, the fixing member can be arranged so as to be separated rearward of the grommet, thus making it easier to prevent the grommet from interfering with the fixing member.

A flange portion that protrudes outward may be provided on a rear end of the outer circumferential surface. According to this configuration, it is possible to prevent the fixing member from falling out rearward from the shielded shell.

Also, a shielded connector according to one aspect includes the shielded shell having any of the above-described configurations; a housing to which the shielded shell is attached; and a terminal fitting accommodated in the housing, wherein the shielding member is provided so as to surround an electrical line connected to the terminal fitting. This configuration realizes a shielded connector that includes the shielded shell.

The shielded connector may further include a cover that clamps the shielded shell along with the housing, and an escape recession portion may be provided at a position that opposes the position restriction portion on the cover. According to this configuration, the position restriction portion can pass through and escape the escape recession portion in the process of attaching the cover. In particular, the position restriction portion is provided on only a certain portion in the circumferential direction on the outer circumferential surface of the shielded shell, thus making it possible to reduce the formation range of the escape recession portion, and prevent the strength of the cover from being reduced more than necessary.

First Embodiment

Figure 8:
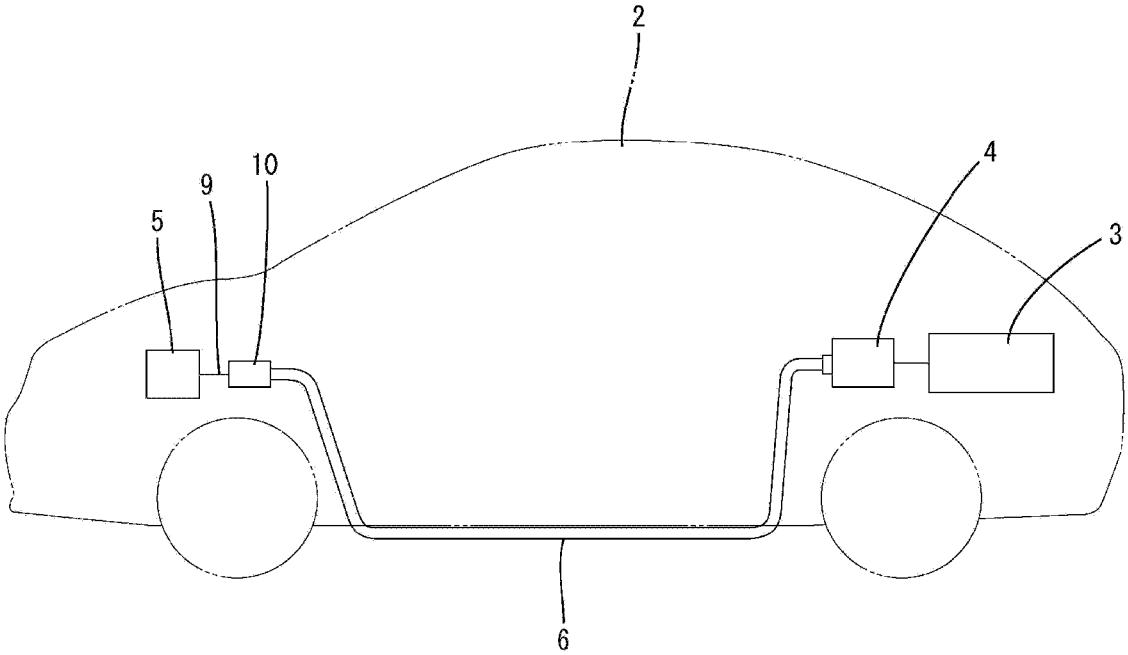
FIG. 8 is a schematic side view of a routing path of a shielded conduction path.

A first embodiment will be described below with reference to the drawings. As shown in FIG. 8, in the first embodiment, a battery 3 is installed in the rear of a vehicle 2, and a shielded conduction path 6 is for supplying electrical power from the battery 3 to an air conditioner compressor 5 via a junction box 4. The first embodiment shows an example of a shielded connector 10 that is provided on an end portion of the shielded conduction path 6, and a shielded shell 12 that is related to the shielded connector 10. The shielded connector 10 is fixed to the end portions of electrical lines 90 that extend from the junction box 4 side and under the floor of the vehicle 2, and is connected to a partner connector 8 (see FIG. 1) that is fixed to the end portion of electrical lines 9 that extend from the compressor 5 side. Note that in the following description, the term "front-rear direction" is based on the left side in FIGS. 1 to 3 being the front side, and the term "up-down direction" is based on the directions shown in the respective figures with the exception of FIG. 3.

Figure 1:
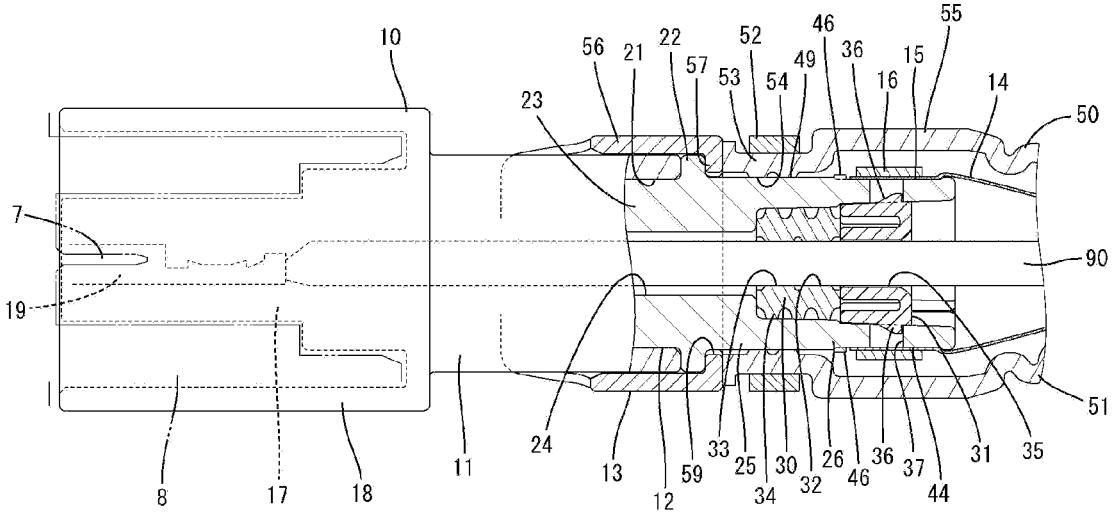
FIG. 1 is a side view of a cross-section of relevant portions of a shielded connector according to a first embodiment.

The shielded connector 10 includes a housing 11 that is made of a synthetic resin, a shielded shell 12 that is made of an electrically conductive metal, and a cover 13 that is made of a synthetic resin. As shown in FIG. 1, a shielding member 14 that surrounds the electrical lines 90 is placed over the outer circumferential surface of the shielded shell 12.

The shielding member 14 is configured as a braided wire constituted by electrically conductive thin metal (e.g., copper) wires that are braided into a tubular shape. The front end portion of the shielding member 14 is fixed to a fixing region 15 of the outer circumferential surface of the shielded shell 12 via a fixing member 16, and the rear end portion of the shielding member 14 is fixed to the end portion of a shielding pipe (not shown), into which the electrical lines 90 are inserted, via another fixing member.

The fixing member 16 is a ring-shaped member that is made of a metal, and when it is placed around the shielding member 14 and then subjected to diameter reduction, the shielding member 14 is fixed by crimping to the shielded shell 12.

The housing 11 has a housing main body 17 and a mating cylinder portion 18 that surrounds the housing main body 17. A space for mating with the partner connector 8 is open in the forward direction between the housing main body 17 and the mating cylinder portion 18. Two terminal fittings 19 (only one is shown in the figures) are accommodated in the housing main body 17. The terminal fittings 19 are configured as female terminal fittings that have a box portion in the front end portion. When the housing 11 is mated to the partner connector 8, male tabs 7 attached to the partner connector 8 are inserted into the box portions of the terminal fittings 19, thus achieving a connection. Also, the terminal fittings 19 are connected to the end portions of the electrical lines 90 by crimping.

As shown in FIG. 1, an insertion recession portion 21 that is open rearward is provided in the housing main body 17, and the shielded shell 12 is inserted into the insertion recession portion 21 from the rear.

The shielded shell 12 extends in the front-rear direction, and a stopper portion 22 that bulges outward is provided in approximately the central portion, with respect to the front-rear direction, of the outer circumferential surface. When the shielded shell 12 is inserted into the insertion recession portion 21, and the stopper portion 22 abuts against the rear end opening of the insertion recession portion 21, the shielded shell 12 is restricted from being inserted any farther.

Figure 4:
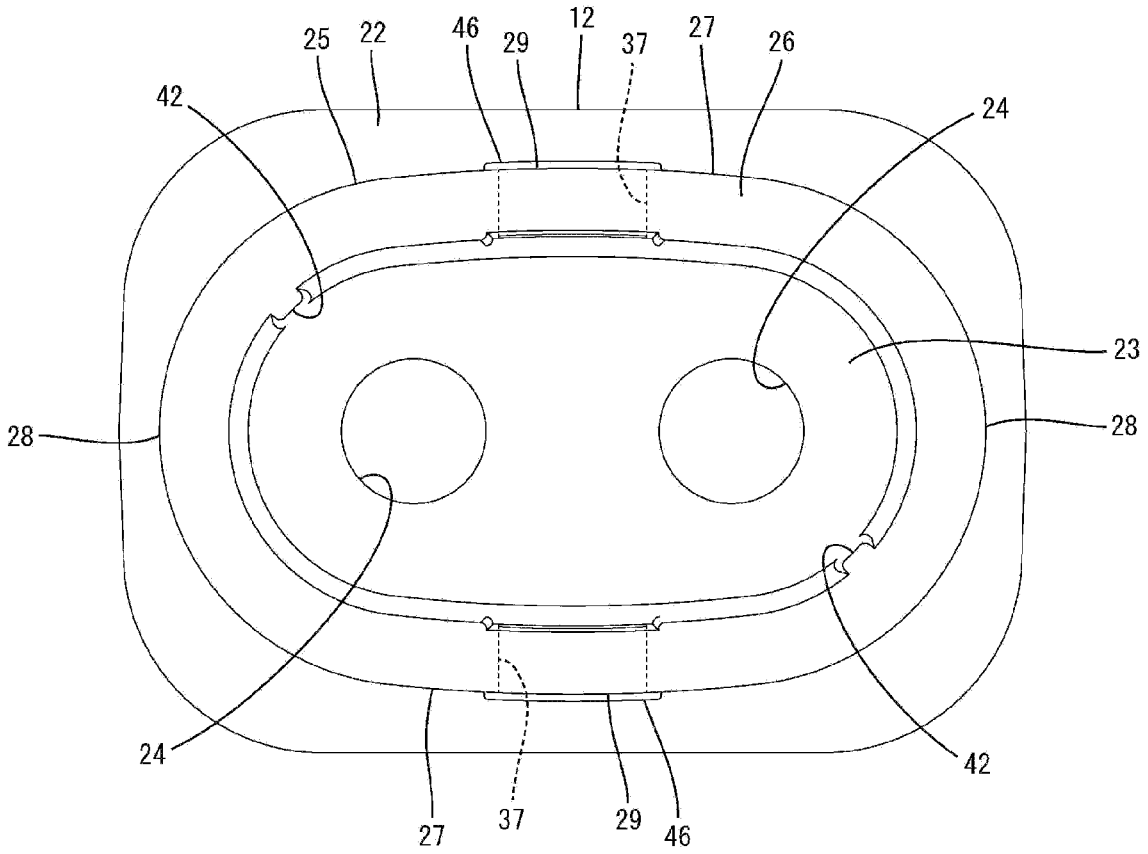
FIG. 4 is a rear view of the shielded shell.

An insertion portion 23 of the shielded shell 12, which is arranged forward of the stopper portion 22, is inserted into the insertion recession portion 21 and comes into contact with and conduction with a ground member (not shown) that is provided on the partner connector 8 side. As shown in FIG. 4, two electrical line insertion holes 24 are provided side-by-side inward of the insertion portion 23. The electrical lines 90 are respectively inserted into the electrical line insertion holes 24.

A connection portion 25 of the shielded shell 12, which is arranged rearward of the stopper portion 22, has a tubular portion 26 that is open rearward. As shown in FIG. 4, the tubular portion 26 has a pair of upper and lower long-side portions 27 and a pair of left and right short-side portions 28. Straight portions 29, which are approximately flat and extend roughly along the left-right direction, are provided in approximately the central portion, with respect to the left-right direction, of the outer circumferential surfaces of the long-side portions 27. The entirety of the outer circumferential surface of each of the short-side portions 28 has a curved shape.

As shown in FIG. 1, a sealing member 30 is inserted into the tubular portion 26 from the rear, and a retainer 31 is inserted following the sealing member 30.

The sealing member 30 is an integrated-type rubber plug, and sealing holes 32 that are put in communication with the electrical line insertion holes 24 are formed side-by-side inside the sealing member 30. When the electrical lines 90 are inserted into the sealing holes 32, and inner circumferential lips 33 provided on the inner circumferential surfaces of the sealing holes 32 elastically come into close contact with the outer circumferential surfaces of the electrical lines 90, a seal is achieved around the electrical lines 90. Also, an outer circumferential lip 34 is provided on the outer circumferential surface of the sealing member 30, and when the sealing member 30 has been inserted into the tubular portion 26, and the outer circumferential lip 34 elastically comes into close contact with the inner circumferential surface of the tubular portion 26, a seal is achieved inside the tubular portion 26.

The retainer 31 is made of a synthetic resin, is arranged so as to be able to abut against the rear surface of the sealing member 30 when inserted into the tubular portion 26, and serves to prevent the sealing member 30 from falling out rearward. Through-holes 35 that are put in communication with the sealing holes 32 are provided side-by-side in the retainer 31. The electrical lines 90 are inserted into the through-holes 35.

Figure 5:
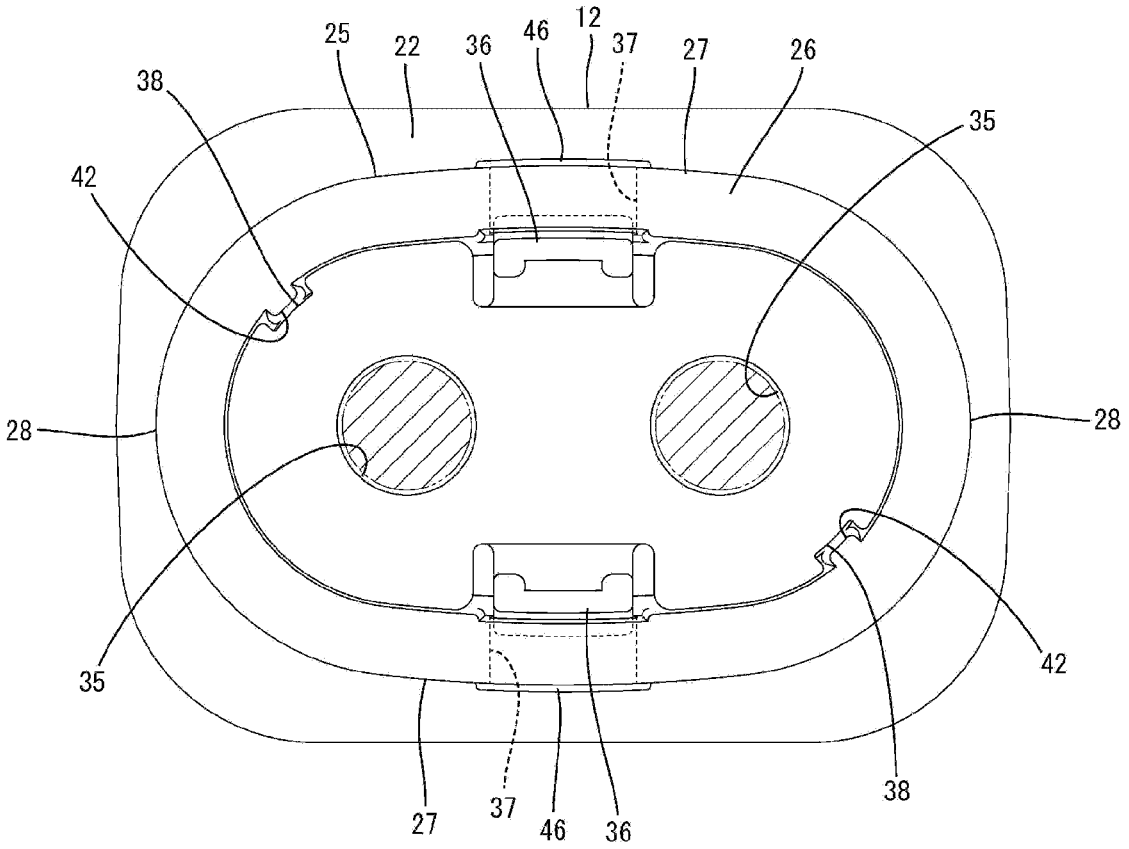
FIG. 5 is a rear view of a state in which a retainer is properly attached to the shielded shell.
Figure 6:
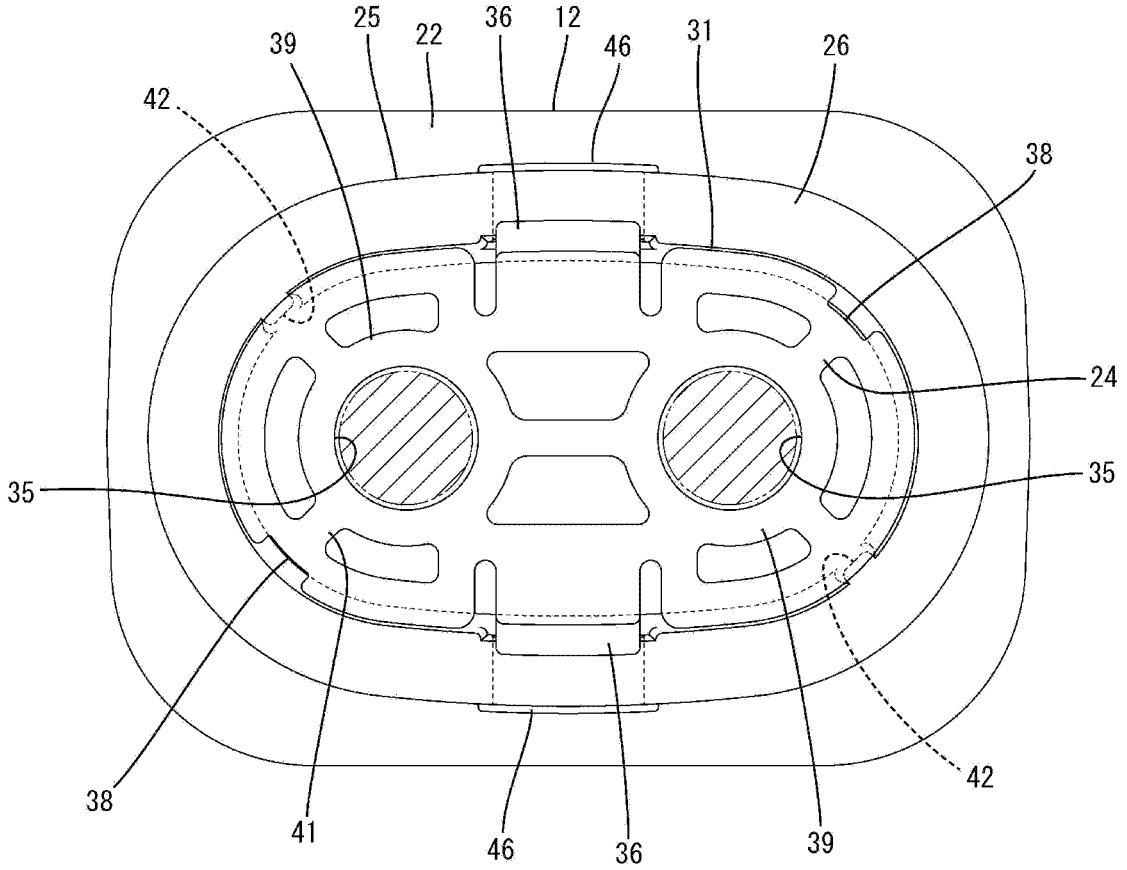
FIG. 6 is a rear view of a state in which an attempt is made to attach the retainer to the shielded shell in a backwards manner.

As shown in FIGS. 5 and 6, a pair of lock pieces 36 are provided on approximately the central portion, with respect to the left-right direction, of the upper and lower end portions of the retainer 31 respectively. The lock pieces 36 can undergo flexing deformation in the up-down direction. Lock holes 37 that receive the lock pieces 36 are formed in approximately the central portion, with respect to the left-right direction, of the two long-side portions 27 of the tubular portion 26 respectively (see FIG. 4). When the lock pieces 36 are elastically fitted into the lock holes 37, the retainer 31 is held to the tubular portion 26.

The outer circumferential surface of the retainer 31 has portions that extend along the inner circumferential surface of the tubular portion 26, and assembly error preventing reception portions 38 that are shaped as recessed grooves are provided as notches in two corner portions that are curved in the diagonal direction. As shown in FIG. 6, reinforcing ribs 41 that extend radially from cylindrical portions 39 that surround the through-holes 35 to the assembly error preventing reception portions 38 are provided on the inner side of the retainer 31. These ribs 41 make it possible to prevent a reduction in the strength of the retainer 31 due to the formation of the assembly error preventing reception portions 38.

Protrusion-shaped assembly error prevention portions 42 are provided on two corner portions that are curved in the diagonal direction on the inner circumferential surface of the tubular portion 26. As shown in FIG. 5, if the retainer 31 is in the proper assembly orientation, the assembly error prevention portions 42 are inserted into the assembly error preventing reception portions 38, and the retainer 31 is inserted into the tubular portion 26 in a guided manner. On the other hand, if the retainer 31 is in a backwards improper assembly orientation as shown in FIG. 6, the assembly error prevention portions 42 abut against the two corner portions in which the assembly error preventing reception portions 38 are not provided at the front end of the retainer 31, and the insertion of the retainer 31 into the tubular portion 26 is prevented. This accordingly prevents a situation in which the retainer 31 is inserted into the tubular portion 26 in the wrong assembly orientation. As a result, the sealing member 30 is appropriately held by the retainer 31, and it is possible to achieve predetermined shielding performance.

Figure 2:
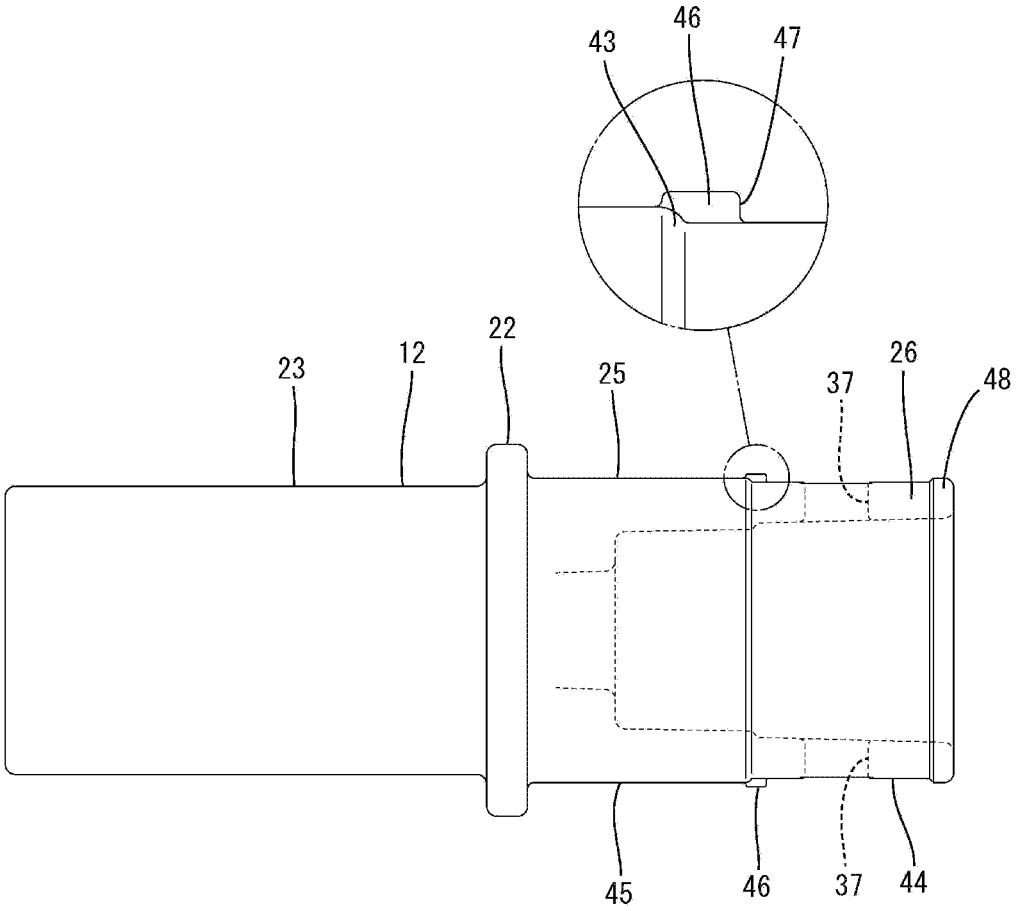
FIG. 2 is a side view of a shielded shell.
Figure 3:
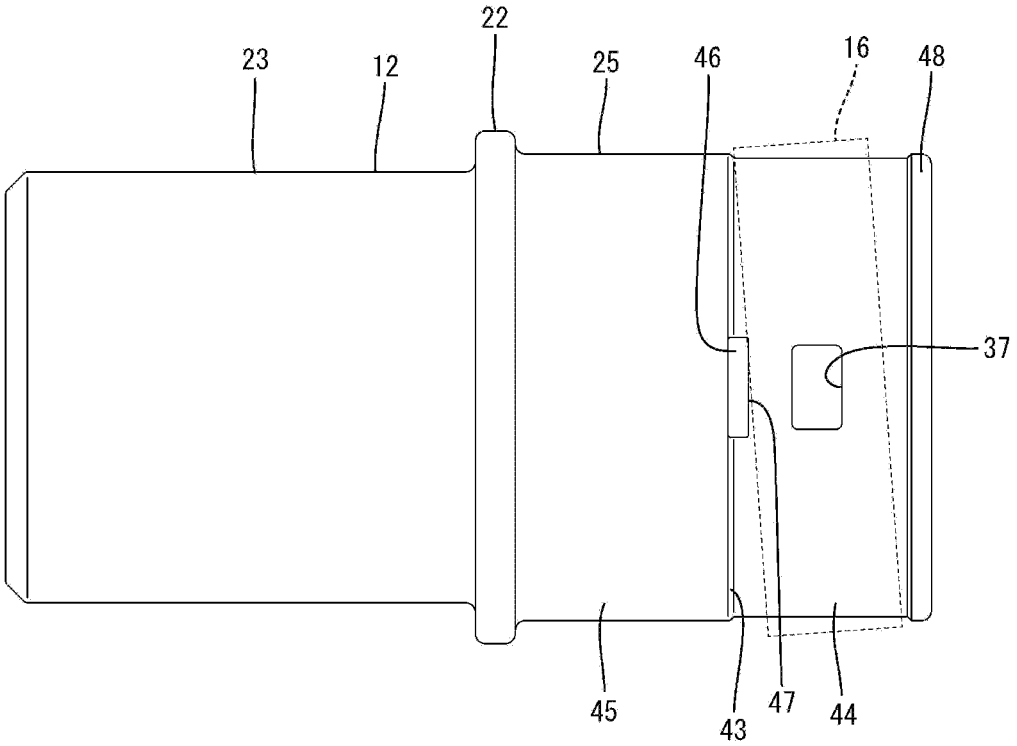
FIG. 3 is a plan view of the shielded shell.

As shown in FIGS. 2 and 3, a step portion 43 is provided over the entire circumference, at a midpoint, with respect of the front-rear direction (specifically, a position somewhat rearward of the center in the front-rear direction), on the outer circumferential surface of the connection portion 25. A rear portion 44 of the outer circumferential surface of the connection portion 25, which is rearward of the step portion 43, has a diameter that is one step smaller than that of a front portion 45 that is forward thereof. The fixing region 15 of the shielding member 14 is provided on the rear portion 44 of the connection portion 25, at a position rearward of later-described position restriction portions 46. The diameter of the step portion 43 decreases from the front portion 45 of the connection portion 25 toward the rear portion 44.

Also, a pair of position restriction portions 46 protrude from two end portions, with respect to the diameter direction (two end portions in the up-down direction), of the straight portions 29 of the outer circumferential surface of the connection portion 25. The position restriction portions 46 are provided so as to be integrated with the step portion 43, and have a protruding dimension that exceeds the depth of the step portion 43. Specifically, the position restriction portions 46 are protrusions (see FIG. 3) on the straight portions 29 of the outer circumferential surface of the connection portion 25 that extend along the step portion 43 in the left-right direction (circumferential direction) while having a front-rear width for extending from the step portion 43 into the rear portion 44 when filling up the step of the step portion 43. The lock holes 37 are arranged rearward of the position restriction portions 46. The length dimension of the position restriction portions 46 in the left-right direction is slightly larger than the opening width of the lock holes 37 in the left-right direction. As shown in FIG. 2, the rear end surfaces of the position restriction portions 46 are arranged so as to extend approximately along the up-down direction, and constitute restriction surfaces 47 that restrict the position of the front end of the fixing member 16.

A flange portion 48 is provided on the rear end of the rear portion 44 of the connection portion 25 so as to bulge outward over the entire circumference. The fixing region 15 of the shielding member 14 is arranged forward of the flange portion 48. Note that the protruding dimension of the position restriction portions 46 is larger than the bulging dimension of the flange portion 48.

As shown in FIG. 1, a sealing region 49, on which the grommet 50 is placed, is provided on the front portion 45 of the connection portion 25 at a position forward of the step portion 43. The grommet 50 is an elastic rubber member made up of an elastomer or the like, is shaped as a cylinder that extends in the front-rear direction, and is attached so as to cover the shielding member 14 from the outside over a range that extends from the shielding pipe (not shown) to the shielded shell 12. The grommet 50 is provided with a bellows portion 51 that is capable of extending and retracting.

The front end portion of the grommet 50 is provided with a sealing portion 53 to which a crimp ring 52 is attached, and multiple sealing lips 54 are provided around the inner circumferential surface of the sealing portion 53. When the front end portion of the grommet 50 is placed over the sealing region 49 of the connection portion 25, and the sealing portion 53 is crimped by the crimp ring 52, the sealing lips 54 elastically come into close contact with the sealing region 49, and a seal is achieved between the shielded shell 12 and the grommet 50. Also, a bulging portion 55 that bulges outward is provided on a portion of the front end portion of the grommet 50 that is rearward of the sealing portion 53. The fixing member 16 is arranged inward of the bulging portion 55, and the grommet 50 does not interfere with the fixing member 16.

Figure 7:
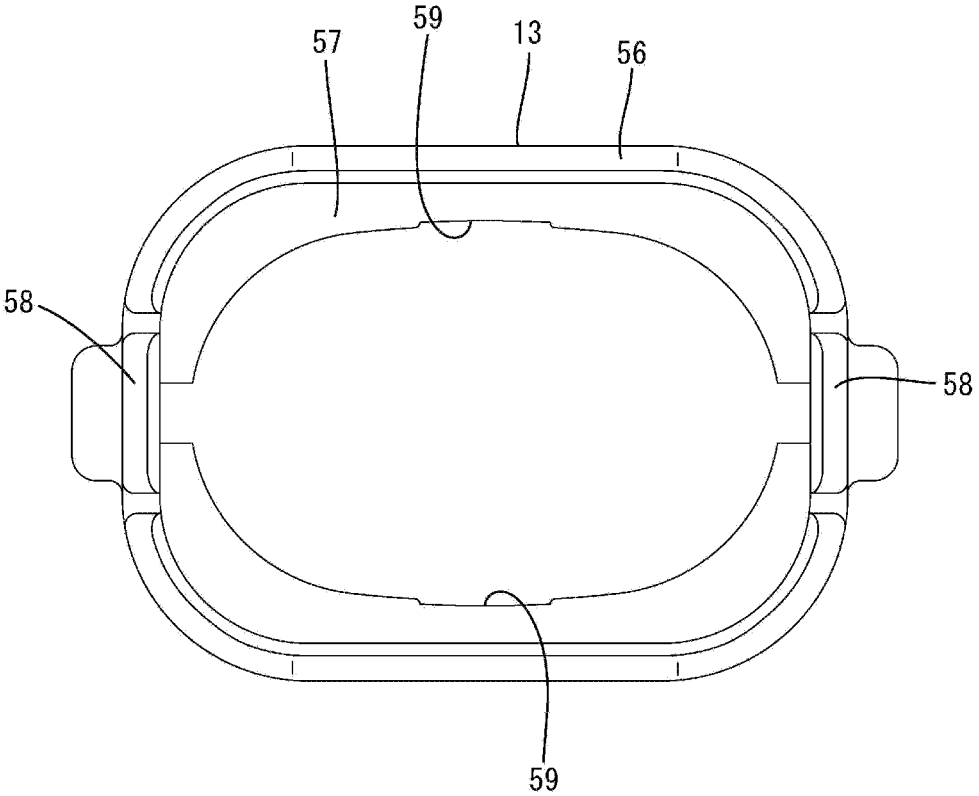
FIG. 7 is a front view of a cover.

The cover 13 is shaped as a cap and is attached to the housing 11 from the rear, and, as shown in FIG. 7, has a tubular outer circumferential portion 56 that extends in the front-rear direction and an inner circumferential brim portion 57 that bulges inward from the rear end of the outer circumferential portion 56. As shown in FIG. 1, the outer circumferential portion 56 is arranged so as to cover, from the outside, a range that extends from the insertion recession portion 21 to the stopper portion 22. The inner circumferential brim portion 57 is arranged so as to be capable of abutting against the stopper portion 22 from the rear, and such that the shielded shell 12 can be inserted therein.

As shown in FIG. 7, a pair of cover lock portions 58 are provided on the two left and right end portions of the outer circumferential portion 56. The cover lock portions 58 can undergo flexing deformation in the left-right direction. Also, a pair of escape recession portions 59 are provided as notches in the inner edge of the two upper and lower end portions of the inner circumferential brim portion 57, at positions for opposing the position restriction portions 46 at the time of attachment to the housing 11. The escape recession portions 59 are shaped as openings that correspond to the outer shape of the position restriction portions 46. When the cover 13 is attached to the housing 11 from the rear, the cover lock portions 58 elastically lock cover lock receiving portions (not shown) provided on the housing 11, and thus the cover 13 is attached to the housing 11. As shown in FIG. 1, when the attachment of the cover 13 is complete, the stopper portion 22 is clamped in the front-rear direction between the rear end of the insertion recession portion 21 and the inner circumferential brim portion 57, and thus the shielded shell 12 is held in a state of being retained on the housing 11.

Next, a procedure for assembly of the shielded connector 10 and the shielding structure will be described.

When assembly is to be performed, the retainer 31, the sealing member 30, the cover 13, the shielded shell 12, and the fixing member 16 are first placed on the electrical lines 90. Next, the terminal fittings 19, which are connected to the end portions of the electrical lines 90, are inserted into the housing main body 17 from the rear. The terminal fittings 19 are held in the housing main body 17 by lances (not shown). Next, the sealing member 30 and the retainer 31 are moved forward so as to be inserted into the tubular portion 26, and the lock pieces 36 of the retainer 31 are locked to the lock holes 37 of the tubular portion 26, thus holding the sealing member 30 in the tubular portion 26. Note that before the electrical lines 90 are inserted into the shielded shell 12, the sealing member 30 and the retainer 31 may be inserted into and held in the tubular portion 26 in advance.

After the insertion portion 23 of the shielded shell 12 has been inserted into the insertion recession portion 21 of the housing main body 17, the cover 13 is moved forward, and the cover lock portions 58 are locked to the cover lock receiving portions (not shown), thus holding the cover 13 on the housing 11. At this time, the stopper portion 22 is clamped between the cover 13 and the housing main body 17, and the shielded shell 12 is held in the housing 11. Also, in the process of attaching the cover 13, the position restriction portions 46 pass through and escape the escape recession portions 59, thus making it possible to prevent the cover 13 from interfering with the position restriction portions 46.

Next, the shielding member 14 is placed over the shielded shell 12 so as to cover the rear portion 44 of the connection portion 25. At this time, the step portion 43 and the position restriction portions 46 serve as markers, thus making it possible to prevent the shielding member 14 from protruding on the front portion 45 side of the connection portion 25. Next, the fixing member 16 is positioned on the outside of the shielding member 14, and the fixing member 16 is crimped in this state, thus fixing the shielding member 14 to the rear portion 44 of the connection portion 25.

Incidentally, if the position restriction portions 46 were not provided on the connection portion 25, and only the step portion 43 were provided, it would be possible for the fixing member 16 to shift forward from the fixing region 15, ride up on the step portion 43, extend into the front portion 45 side of the connection portion 25, and interfere with the sealing portion 53 of the grommet 50. Thus, in the case of the first embodiment, the position restriction portions 46 that have the restriction surfaces 47 for restricting advancement of the fixing member 16 are provided on the connection portion 25, and thus the fixing member 16 abuts against the restriction surfaces 47 of the position restriction portions 46 and is prevented from extending into the front portion 45 side of the connection portion 25. As a result, it is possible to prevent the fixing member 16 from interfering with the sealing portion 53 of the grommet 50.

On the other hand, the position restriction portions 46 are provided on only certain portions in the circumferential direction, and therefore although there is a possibility of the fixing member 16 becoming tilted relative to the front-rear direction (see the dashed line portion in FIG. 3), in the case of the first embodiment, the front end of the fixing member 16 abuts against the step portion 43, thus suppressing the fixing member 16 from becoming tilted any further. Also, the fixing member 16 is prevented from becoming shifted rearward by abutting against the flange portion 48.

As described above, after the shielding member 14 is fixed to the shielded shell 12, the grommet 50 is placed over the front portion 45 of the connection portion 25 and crimped by the crimp ring 52, thus fixing the sealing portion 53 of the grommet 50 to the shielded shell 12. At this time, the fixing member 16 is arranged inward of the bulging portion 55, thus making it possible to prevent the grommet 50 from interfering with the fixing member 16. In particular, in the case of the first embodiment, the fixing member 16 is held in a state of being positioned rearward of the position restriction portions 46, and thus the fixing member 16 is located at a position sufficiently separated from the sealing portion 53, thus making it possible to more reliably prevent the sealing portion 53 from interfering with the fixing member 16. As a result, the sealing performance of the sealing portion 53 is maintained in a favorable state.

As described above, according to the first embodiment, the position of the front end of the fixing member 16 is restricted by the position restriction portions 46, thus making it possible to prevent the fixing member 16 from becoming shifted forward relative to the shielded shell 12 and interfering with the grommet 50 at a forward position. In this case, the position restriction portion 46 is provided on only certain portions in the circumferential direction on the outer circumferential surface of the shielded shell 12, thus making it possible to more easily avoid interference between the grommet 50 and the position restriction portions 46, as well as reduce the formation range (open range) of the escape recession portions 59 of the cover 13, and suppress a reduction in the strength of the cover 13.

On the other hand, if the position restriction portions 46 are provided on only certain portions in the circumferential direction on the outer circumferential surface of the shielded shell 12, there is concern that the fixing member 16 will become tilted in a direction that intersects the front-rear direction, but in the first embodiment, the front end of the fixing member 16 abuts against the step portion 43, thus making it possible to suppress tilting of the fixing member 16.

Also, the outer circumferential surface of the shielded shell 12 has the approximately flat straight portions 29, and the position restriction portions 46 are provided on the straight portions 29, thus making it easier to mold the position restriction portions 46, and making it easier to visually recognize the position restriction portions 46.

Also, the grommet 50, which is shaped so as to surround the shielding member 14 and the fixing member 16, is placed over the front portion 45 of the connection portion 25 of the shielded shell 12, and the position restriction portions 46 are provided so as to extend into the rear portion 44 of the connection portion 25, thus making it possible to arrange the fixing member 16 so as to be separated rearward of the grommet 50, and making it possible to more reliably prevent the grommet 50 from interfering with the fixing member 16.

Furthermore, the flange portion 48 is provided so as to bulge outward from the rear end of the outer circumferential surface of the shielded shell 12, thus making it possible to prevent the fixing member 16 from falling off rearward from the shielded shell 12.

Furthermore, the shielded connector 10 includes the cover 13 that clamps the shielded shell 12 along with the housing 11, and the escape recession portions 59 are provided at positions that oppose the position restriction portion 46 on the cover 13, thus making it possible for the position restriction portions 46 to pass through and escape the escape recession portions 59 in the process of attaching the cover 13.

Other Embodiments

The following is a brief description of other embodiments.

A configuration is possible in which the position restriction portions are not provided so as to be integrated with the step portion, but rather are provided so as to be separated rearward of the step portion.

The position restriction portions may be provided at the same position as the step portion in the front-rear direction.

The position restriction portion may be provided at only one location in the circumferential direction on the outer circumferential surface of the shielded shell, or may be provided at three or more locations in the circumferential direction with gaps therebetween.

The other member that is arranged on the front portion of the shielded shell and for which there is concern of interference with the fixing member is not limited to the grommet, and may be a sealing ring or a grounding member, for example.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A shielded connector comprising:

a shielded shell having an outer circumferential surface on which a shielding member is to be placed and fixed by a fixing member, the outer circumferential surface being provided with a step portion that increases in diameter from a rear portion at which a fixing region of the shielding member is positioned toward a front portion, and a position restriction portion that protrudes outward from a portion of the outer circumferential surface in a circumferential direction and restricts a position of a front end of the fixing member that is to be attached to the fixing region, a housing to which the shielded shell is attached, a terminal fitting accommodated in the housing, and a cover that clamps the shielded shell along with the housing, wherein the shielding member is provided so as to surround an electrical line connected to the terminal fitting, and wherein an escape recession portion is provided at a position that opposes the position restriction portion on the cover.

2. The shielded connector according to claim 1, wherein the outer circumferential surface has an approximately flat straight portion, and the position restriction portion is provided on the straight portion.

3. The shielded connector according to claim 1, wherein a grommet that surrounds the shielding member and the fixing member is placed over the front portion, and the position restriction portion is provided so as to extend into the rear portion.

4. The shielded connector according to claim 1, wherein a flange portion that protrudes outward is provided on a rear end of the outer circumferential surface.

* * * * *